US006918424B2

(12) United States Patent
Lin

(10) Patent No.: US 6,918,424 B2
(45) Date of Patent: Jul. 19, 2005

(54) CORD WINDING DEVICE FOR A BLIND

(76) Inventor: Ke-Min Lin, No. 18, Tai-Shan 2nd St., West Dist., Chiayi City (TW)

( * ) Notice: Subject to any disclaimer, the term of this patent is extended or adjusted under 35 U.S.C. 154(b) by 0 days.

(21) Appl. No.: 10/719,094

(22) Filed: Nov. 21, 2003

(65) Prior Publication Data

US 2005/0109472 A1 May 26, 2005

(51) Int. Cl.[7] ..... E06B 9/30
(52) U.S. Cl. ..... 160/171
(58) Field of Search ..... 160/171, 170, 160/168.1 R, 176.1 R, 177 R, 178.1 R, 84.04, 160/84.05, 121.1

(56) References Cited

U.S. PATENT DOCUMENTS 2,765,030 A * 10/1956 Bechtler ..... 160/170
5,070,927 A * 12/1991 Chen ..... 160/344
5,103,888 A * 4/1992 Nakamura ..... 160/171
5,318,090 A * 6/1994 Chen ..... 160/171
5,328,113 A 7/1994 de Chevron Villette et al.
5,645,118 A * 7/1997 Lagarde ..... 160/170
6,158,494 A * 12/2000 Huang ..... 160/84.05
6,659,156 B2 * 12/2003 Wen et al. ..... 160/168.1 P

* cited by examiner

*Primary Examiner*—David Purol
(74) *Attorney, Agent, or Firm*—Frommer Lawrence & Haug LLP; Ronald R. Santucci

(57) ABSTRACT

A cord winding device includes a cord adapted to lift and lower a blind, a winding screw which is rotatable for winding and unwinding the cord and which has a screw thread portion, and a guide body sleeved on the winding screw. The guide body and the winding screw make an axial movement relative to each other upon rotation of the winding screw. The guide body includes an inner thread threadedly engaging the screw thread portion, and a cord-pulling member formed with a hole. The cord passes through the hole, and has one end fixed to the winding screw. The cord is pulled by the cord-pulling member to be wound up around the screw thread portion upon rotation of the winding screw.

3 Claims, 6 Drawing Sheets

CORD WINDING DEVICE FOR A BLIND

BACKGROUND OF THE INVENTION

1. Field of the Invention

The invention relates to a winding device, more particularly to a cord winding device for a window blind.

2. Description of the Related Art

U.S. Pat. No. 5,328,113 discloses a device for winding a suspension cord of a window blind. The device is mounted in a casing, and includes a winding drum on which there is fixed one end of the cord to be wound. To raise slats of the blind, the winding drum is simply activated so as to wind the suspension cord. However, when a number of turns of the suspension cord are wound around an outer periphery of the winding drum increases, different turns of the suspension cord are likely to overlap each other and got entangled. As such, when the blind is lowered, because the turns of the suspension cord overlap and are entangled, the blind cannot be lowered smoothly.

SUMMARY OF THE INVENTION

Therefore, the object of the present invention is to provide a cord winding device that can prevent overlapping of a cord of a window blind so that slats of the blind can be lifted and lowered smoothly. According to this invention, a cord winding device comprises a cord adapted to lift and lower a blind, a winding screw which is rotatable for winding and unwinding the cord, and a guide body sleeved on the winding screw. The winding screw has a screw thread portion. The guide body and the winding screw make an axial movement relative to each other upon rotation of the winding screw. The guide body includes an inner thread threadedly engaging the screw thread portion, and a cord-pulling member formed with a hole. The cord passes through the hole, and has one end fixed to the winding screw. The cord is pulled by the cord-pulling member to be wound up around the screw thread portion upon rotation of the winding screw.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
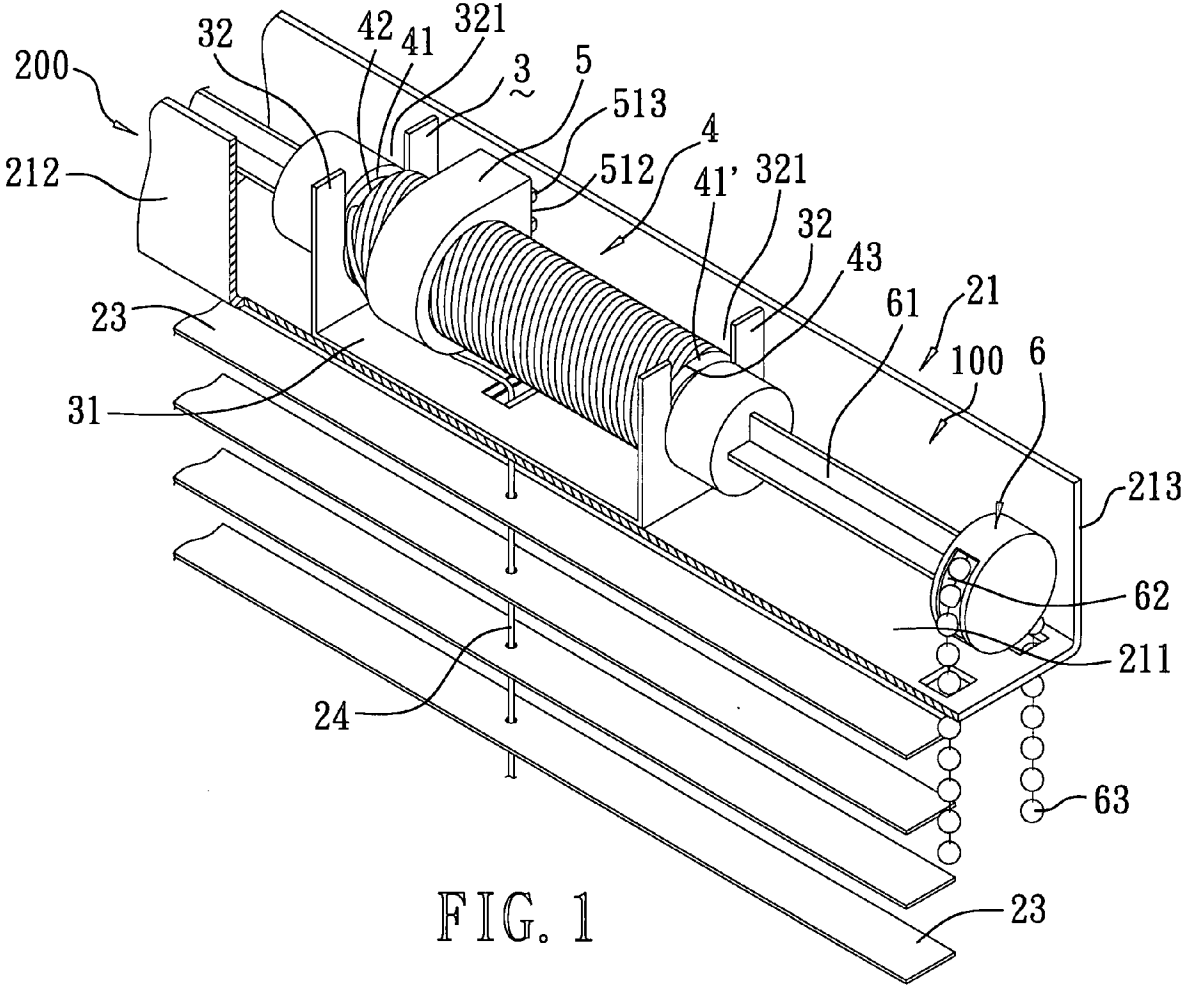
FIG. 1 is a fragmentary perspective view of a window blind incorporating the first preferred embodiment of the present invention.

Before the present invention is described in greater detail, it should be noted that like elements are denoted by the same reference numerals throughout the disclosure.

Figure 2:
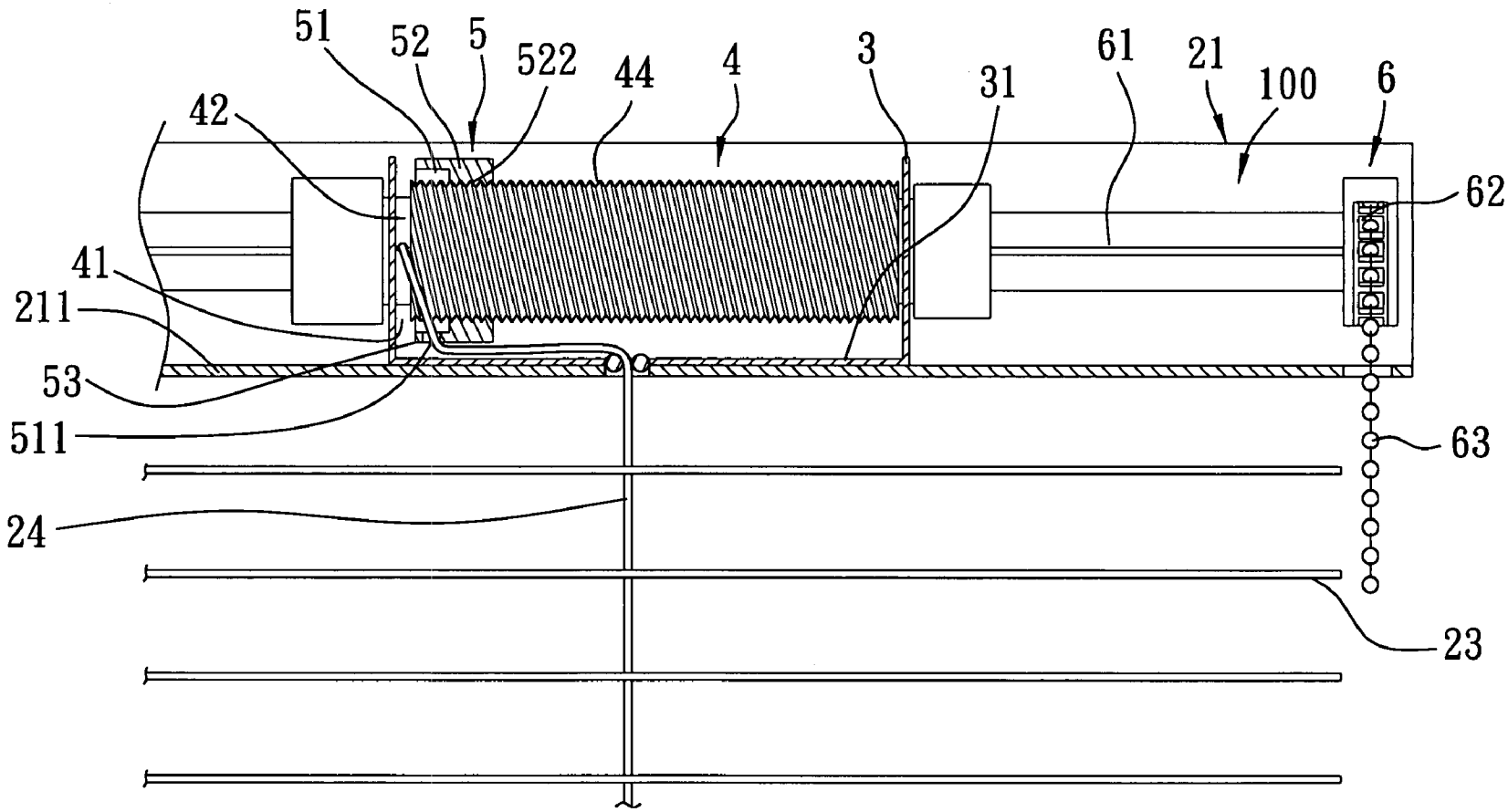
FIG. 2 is a fragmentary sectional view of the first preferred embodiment.
Figure 3:
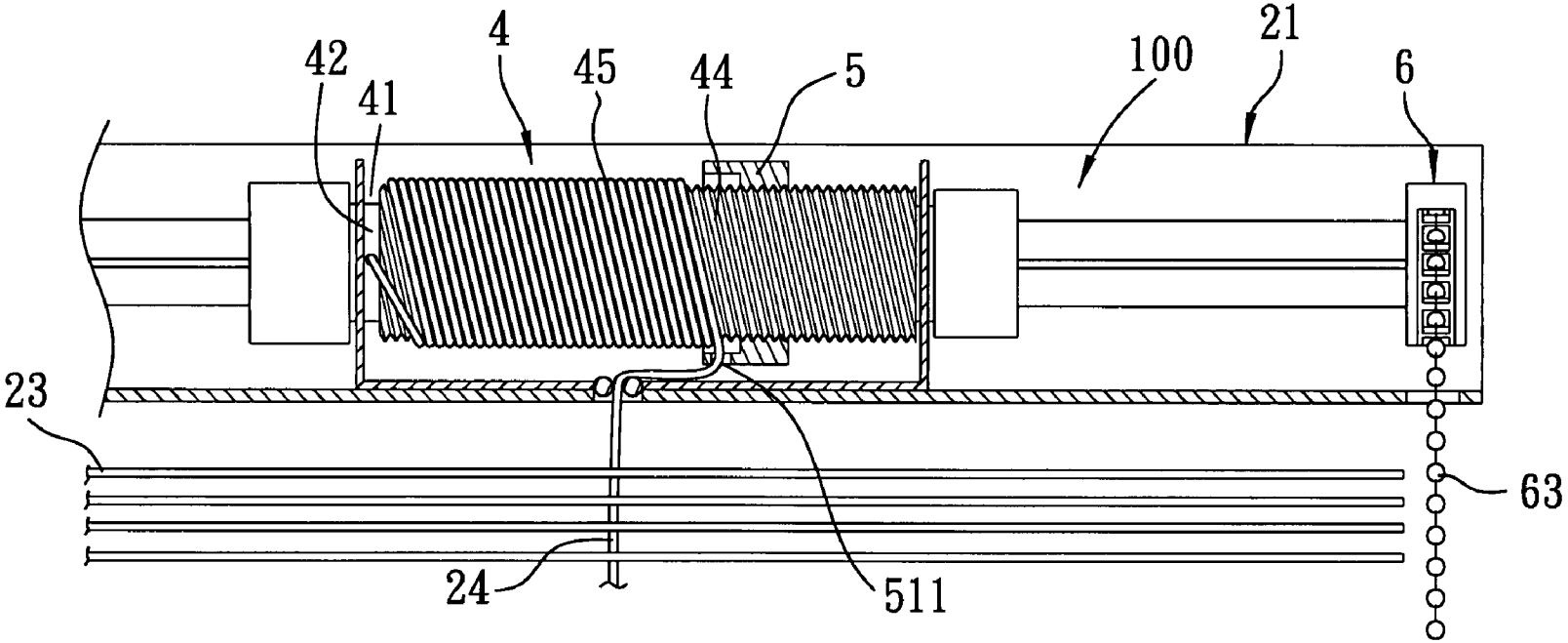
FIG. 3 is a view similar to FIG. 2, showing how slats of the blind can be lifted.

Referring to FIGS. 1 to 3, the first preferred embodiment of a cord winding device 100 according to the present invention is shown to be adapted to be incorporated in a window blind 200 having a plurality of parallel slats 23. The cord winding device 100 comprises a casing 21, a cord 24 adapted to lift and lower the slats 23, a winding screw 4, a guide body 5, a driving device 6, and a rotating shaft 61. In this embodiment, a horizontal window blind is exemplified. However, use of the present invention should not be limited thereto as the present invention is also applicable to other kinds of vertically lifted and lowered blinds.

The casing 21 is mounted fixedly on a window frame (not shown), and has a bottom wall 211, and front and rear walls 212, 213 extending upwardly and respectively from front and rear edges of the bottom wall 211. A bracket 3 is mounted fixedly within the casing 21, and has a fixed plate 31 secured on the bottom wall 211 of the casing 21, and a pair of axially spaced-apart connecting plates 32 extending integrally, upwardly and respectively from left and right ends of the fixed plate 31. Each connecting plate 32 is formed with an aperture 321.

A rotating shaft 61 is mounted within the casing 21 to support and rotate the winding screw 4. The winding screw 4 is mounted co-rotatably on the rotating shaft 61 for winding and unwinding the cord 24, and is limited between the connecting plates 32 of the bracket 3. The winding screw 4 has an externally threaded screw thread portion 44 (see FIG. 3) with two axially spaced-apart first and second ends 42, 43, and two annularly grooved parts 41, 41' proximate to the first and second ends 42, 43. The grooved parts 41, 41' are received respectively in the apertures 321 in the connecting plates 32.

One end of the cord 24 is fixed to the slats 23 in a conventional manner, and the other end is fixed within a slot in the grooved part 41 of the winding screw 4. In particular, the cord 24 passes through the lowest slat 23 in a conventional manner, through the bottom wall 211 of the casing 21, through the fixed plate 31 of the bracket 3, and extends into a large-diameter hole portion 51 of the guide body 5 through a hole 511 in the latter so as to be fixed within the grooved part 41 of the winding screw 4.

The guide body 5 is sleeved on the winding screw 4, and is movable from the first end 42 to the second end 43 of the winding screw 4 when the winding screw 4 is rotated. The guide body 5 is capable of making an axial movement relative to the winding screw 4 upon rotation of the winding screw 4. The guide body 5 includes the large-diameter hole portion 51 (see FIG. 2) proximate to the first end 42, and a threaded part 52 (see FIG. 2) opposite to the large-diameter hole portion 51 and having an inner diameter smaller than that of the large-diameter hole portion 51. The large-diameter hole portion 51 has a cord-pulling member 53 formed with the hole 511 (see FIG. 2) to permit the cord 24 to extend downwardly from the winding screw 4. The cord-pulling member 53 projects axially from the threaded part 52, and is spaced radially apart from the screw thread portion 44 of the winding screw 4. The threaded part 52 is formed with an inner thread 522 (see FIG. 2) threadedly engaging the screw thread portion 44 of the winding screw 4.

When the winding screw 4 is rotated, the cord-pulling member 53 pulls the cord 24 so as to wind the same around the screw thread portion 44 of the winding screw 4 so that the slats 23 of the window blind 200 can be lifted.

The guide body 5 further includes a planar surface portion 512 confronting the rear wall 213 of the casing 21 and formed with a plurality of sliding elements 513 to contact the rear wall 213. The planar surface portion 512, through the sliding elements 513, slides along the rear wall 213 when the guide body 5 moves along the winding screw 4 by virtue of threading action. However, the guide body 5 is restrained by the rear wall 213 from being rotated with the winding screw 4.

The driving device 6 includes a rotary wheel 62 sleeved on the rotating shaft 61 for simultaneous rotation therewith, and a chain 63 for rotating the rotary wheel 62. The chain 63 is pulled so as to rotate the rotary wheel 62, which in turn rotates the rotating shaft 61 along with the winding screw 4. It should be noted that the driving device 6 can employ an electric-driven motor to achieve its purpose of rotating the winding screw 4.

When the slats 23 are lowered so as to cover a window, the guide body 5 is located proximate to the first end 42 of the winding screw 4, and the cord 24 is unwound from the screw thread portion 44 of the winding screw 4, as best shown in FIG. 2. When lifting of the slats 23 is desired, the chain 63 of the driving device 6 is pulled in a first direction so as to rotate the winding screw 4. At this time, the guide body 5 will move from the first end 42 toward the second end 43 of the winding screw 4, and the cord 24 is pulled by the cord-pulling member 53 so as to be wound sequentially and helically along the pattern of the screw thread portion 44 of the winding screw 4, as best illustrated in FIG. 3. As such, the cord 24 makes turns sequentially around the screw thread portion 44, and the slats 23 are lifted.

When the slats 23 are stacked above the window, the guide body 5 is located proximate to the second end 43 of the winding screw 4. When lowering of the slats 23 is desired so as to cover the window, the chain 63 of the driving device 6 is pulled in a second direction opposite to the first direction so as to enable the winding screw 4 to rotate in a reverse direction, wherein the guide body 5 is moved from the second end 43 toward the first end 42 of the winding screw 4, so that the cord 24 can be sequentially unwound from the screw thread portion 44 of the winding screw 4 and lowered through the hole 511. Because the cord 24 is wound sequentially around the screw thread portion 44 of the winding screw 4 without overlapping the turns of the cord 24, the cord 24 is prevented from getting entangled, and the slats 23 can be lowered smoothly.

Figure 4:
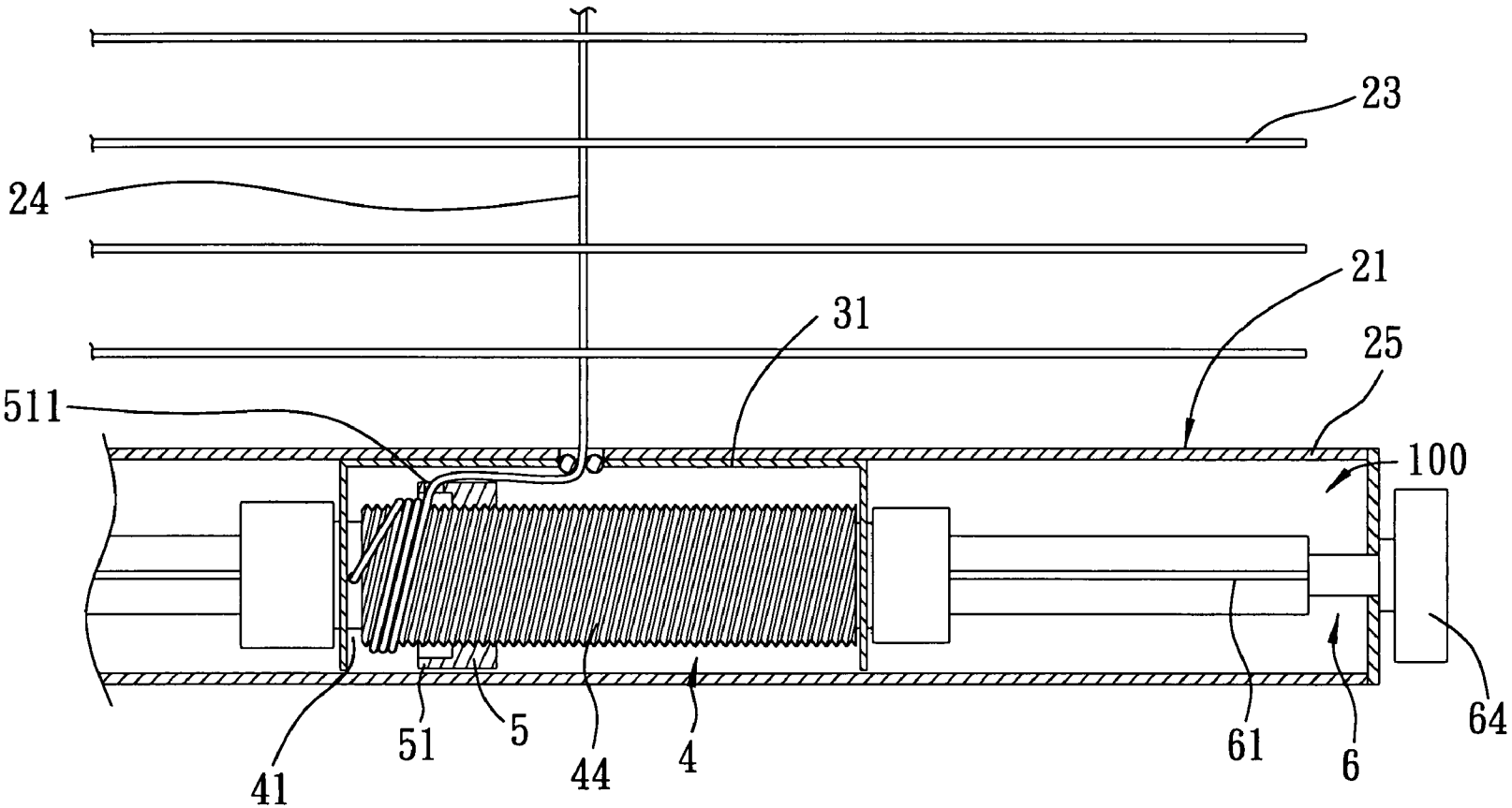
FIG. 4 is a fragmentary sectional view of a window blind incorporating the second preferred embodiment of the present invention.

Referring to FIG. 4, the second preferred embodiment of the cord winding device 100 according to the present invention is shown to be substantially similar to the first preferred embodiment. However, in this embodiment, the cord winding device 100 is provided with a control knob 64 that is attached to the rotating shaft 61, that is disposed outside of the casing 21, and that is operable by an external force. The casing 21 is mounted below the slats 23 in this embodiment. The cord hole 511 in the guide body 5 permits the cord 24 to extend upwardly from the winding screw 4. The other end of the cord 24 extends through a top wall 25 of the casing 21, through the fixed plate 31 of the bracket 3, and into the large-diameter hole portion 51 of the guide body 5 through the hole 511 so as to be fixed within the grooved part 41 of the winding screw 4. When lifting of the slats 23 is desired, the control knob 64 is simply rotated so as to rotate the winding screw 4 and to wind simultaneously the cord 24 around the screw thread portion 44 of the winding screw 4.

The driving device 6, in this embodiment, does not include the chain 63 (see FIG. 1) so as to prevent possible damage due to children pulling or playing with the chain 63, or possible harm when the chain is wrapped around the neck of a child.

Figure 5:
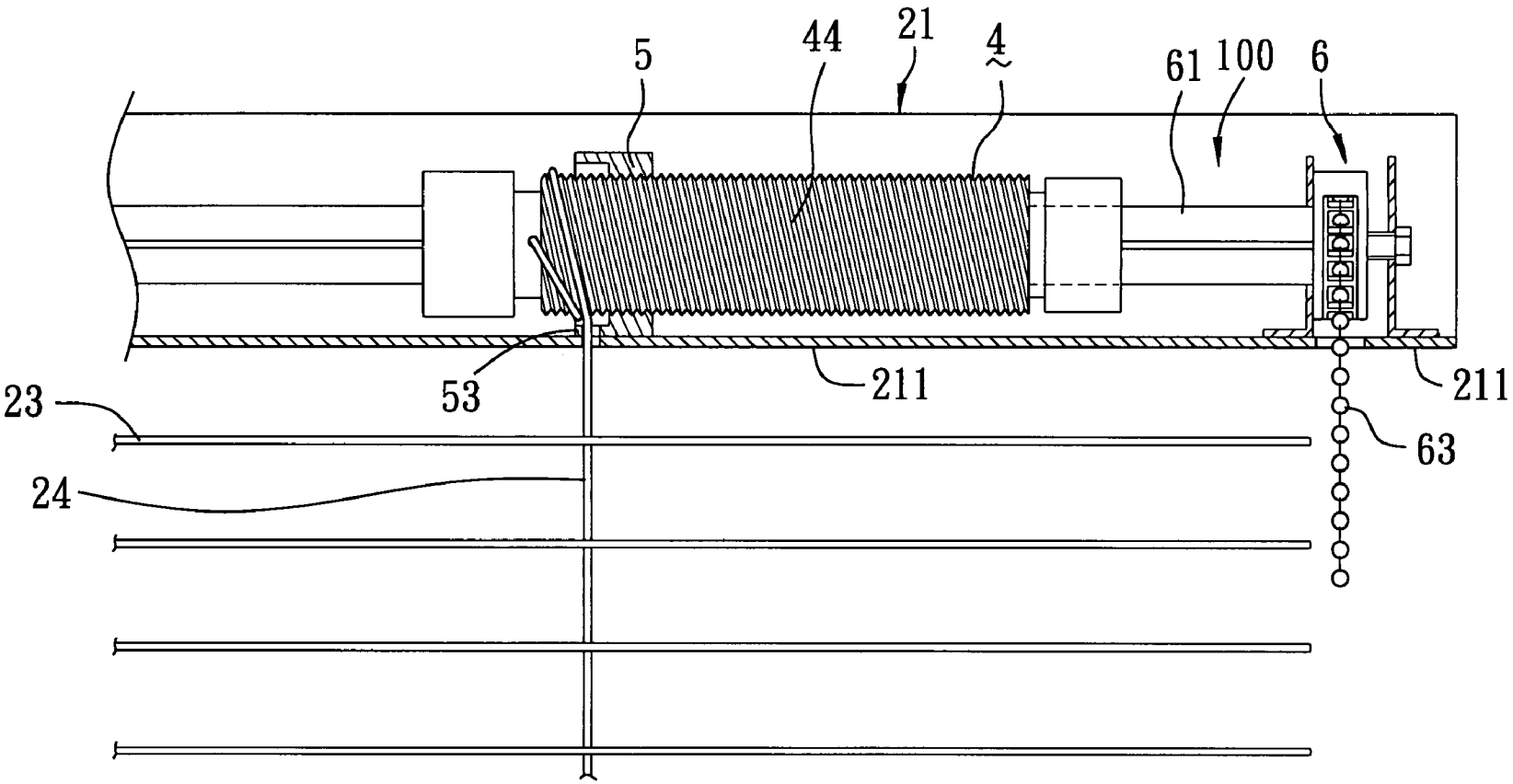
FIG. 5 is a fragmentary sectional view of a window blind incorporating the third preferred embodiment of the present invention.
Figure 6:
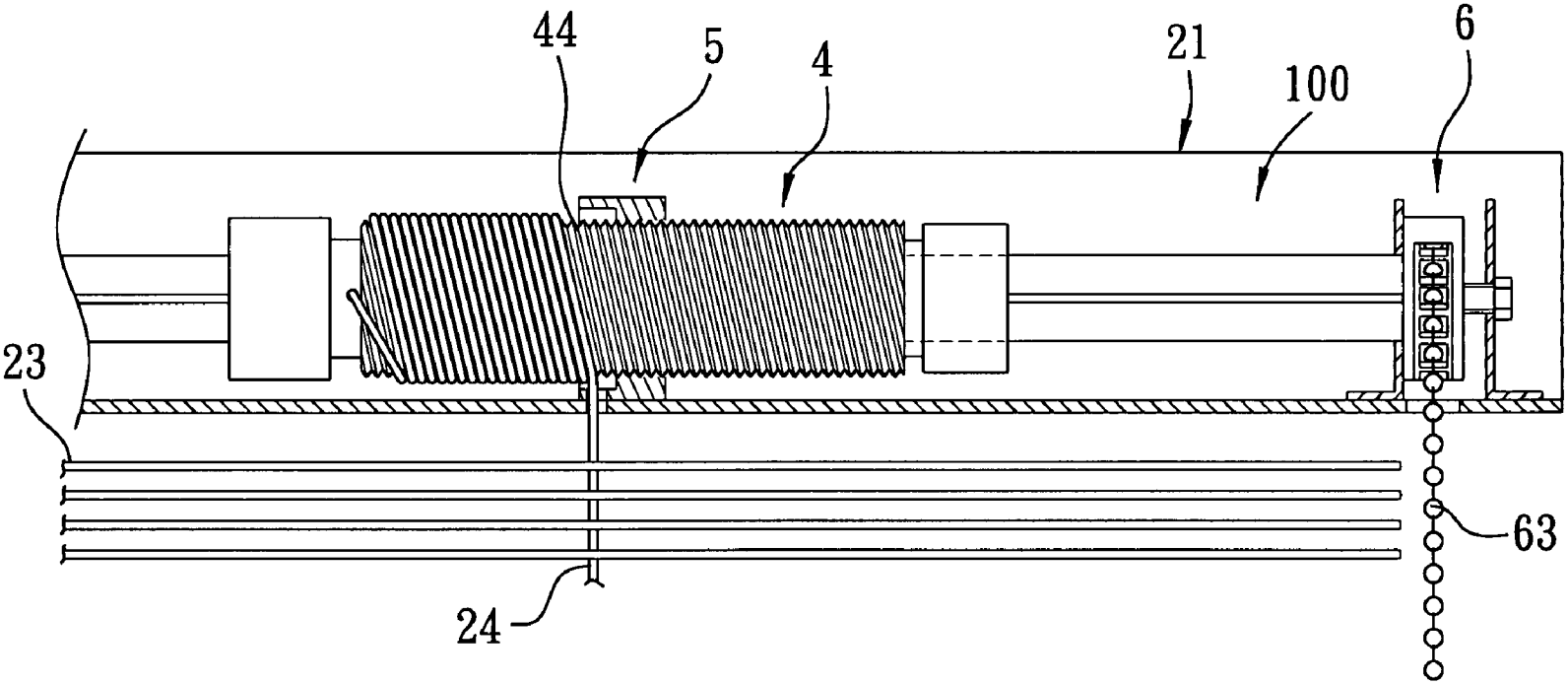
FIG. 6 is a view similar to FIG. 5, illustrating how slats of the blind can be lifted.

Referring to FIGS. 5 and 6, the third preferred embodiment of the cord winding device 100 according to the present invention is shown to be substantially similar to the first preferred embodiment. However, in this embodiment, the guide body 5 is fixed immovably on the bottom wall 211 of the casing 21 by means of an adhesive or a screw bolt (not shown). The rotating shaft 61 is inserted axially into the winding screw 4 so that the winding screw 4 is slidable relative to the shaft 61. It should be noted that the bracket 3 (see FIG. 1) is dispensed herewith so that the winding screw 4 can move rotatably and axially within the casing 21.

When lifting of the slats 23 is desired, as shown in FIG. 6, the chain 63 of the driving device 6 is pulled to rotate the winding screw 4. The cord-pulling member 53 pulls the cord 24 at this time so as to wind the same around the screw thread portion 44 of the winding screw 4. Simultaneously, the winding screw 4 moves rotatably and slidably away from the driving device 6. When lowering of the slats 23 is desired, the driving device 6 is rotated in a reverse direction so as to move the winding screw 4 rotatably and slidably toward the driving device 6, thereby unwinding the cord 24 at the same time, and thereby achieving the purpose of lowering the slats 23.

From the aforementioned description of the preferred embodiments of the present invention, it is apparent that through coordination of the winding screw 4 and the guide body 5, the cord 24 can be wound around and unwound from the winding screw 4 so as to lift and lower the window blind 200. Moreover, the winding screw 4 can make relative movement with the guide body 5 so that the cord 24 can be wound sequentially around the screw thread portion 44 of the winding screw 4 without overlapping and entangling so that lowering of the slats 23 can be accomplished smoothly.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A cord winding device for a blind comprising:

a cord adapted to lift and lower the blind;

a winding screw which is rotatable for winding and unwinding said cord, said winding screw having a screw thread portion;

a guide body sleeved on said winding screw, said guide body and said winding screw making an axial movement relative to each other upon rotation of said winding screw, said guide body including an inner thread threadedly engaging said screw thread portion, and a cord-pulling member formed with a hole;

a casing for receiving said winding screw;

a rotating shaft mounted within said casing to support and rotate said winding screw; and a bracket mounted fixedly within said casing and having a pair of axially spaced-apart connecting plates, said winding screw being limited between said connecting plates;

wherein said cord passes through said hole and has one end fixed to said winding screw, said cord being pulled by said cord-pulling member to be wound up around said screw thread portion upon rotation of said winding screw, and wherein said winding screw further includes two annularly grooved parts proximate to said first and second ends, said connecting plates having apertures to receive respectively said grooved parts.

2. The cord winding device as claimed in claim 1, wherein said one end of said cord is fixed within one of said grooved parts.

3. A cord winding device for a blind comprising:

a cord adapted to lift and lower the blind;

a winding screw which is rotatable for winding and unwinding said cord, said winding screw having a screw thread portion; and a guide body sleeved on said winding screw, said guide body and said winding screw making an axial movement relative to each other upon rotation of said winding screw, said guide body including an inner thread threadedly engaging said screw thread portion, and a cord-pulling member formed with a hole; and a casing for receiving said winding screw, said guide body further including a planar surface portion confronting a wall of said casing and restrained by said wall from being rotated with said winding screw;

wherein said cord passes through said hole and has one end fixed to said winding screw, said cord being pulled by said cord-pulling member to be wound up around said screw thread portion upon rotation of said winding screw;

wherein said guide body further includes a threaded part formed with said inner thread, said cord-pulling member projecting axially from said threaded part and being spaced apart radially from said screw thread portion; and wherein said planar surface portion is formed with a plurality of sliding elements to contact said wall.

* * * * *